US005103601A

United States Patent [19]

Hunt

[11] Patent Number: 5,103,601

[45] Date of Patent: Apr. 14, 1992

[54] TRILATERAL GUTTER GUARD

[75] Inventor: Robert Hunt, P.O. Box 107, Allamuchy, N.J. 07820

[73] Assignee: Robert Hunt, Allamuchy, N.J.

[21] Appl. No.: 509,166

[22] Filed: Apr. 16, 1990

[51] Int. Cl.[5] ..... E04D 13/00

[52] U.S. Cl. ..... 52/12; 210/474

[58] Field of Search ..... 52/12, 11; 210/474, 210/473

[56] References Cited

U.S. PATENT DOCUMENTS

| | | | |
|---|---|---|---|
| 550,173 | 11/1895 | Hitt . | |
| 732,416 | 6/1903 | Jones . | |
| 1,597,503 | 8/1926 | Andrews . | |
| 2,219,953 | 10/1940 | Fry . | |
| 2,317,272 | 4/1943 | Hughes . | |
| 2,457,940 | 1/1949 | Swenson . | |
| 2,526,271 | 10/1950 | Probst . | |
| 3,428,183 | 2/1969 | Bristow | 52/12 X |
| 4,112,691 | 9/1978 | Ebeling et al. . | |
| 4,253,281 | 3/1981 | Ruttenberg . | |
| 4,493,588 | 1/1985 | Duffy . | |
| 4,573,290 | 3/1986 | Fleming . | |
| 4,592,174 | 6/1986 | Hileman . | |
| 4,607,465 | 8/1986 | Hopkins . | |
| 4,769,957 | 9/1988 | Knowles . | |
| 4,841,686 | 6/1989 | Rees . | |
| 4,949,514 | 8/1990 | Weller | 52/12 |
| 4,964,247 | 10/1990 | Spica | 52/12 |

*Primary Examiner*—David A. Scherbel
*Assistant Examiner*—Lan Mai
*Attorney, Agent, or Firm*—Fitzpatrick, Cella, Harper & Scinto

[57] ABSTRACT

A trilateral gutter guard includes first and second angled legs adapted to rest at different locations on a gutter bottom. A substantially horizontal leg is coupled to the top of the first and second legs, the three legs each comprising a mesh. Preferably, the horizontal leg is positioned and dimensioned to allow self-cleaning of the gutter guard by natural forces.

18 Claims, 2 Drawing Sheets

FIG. 1
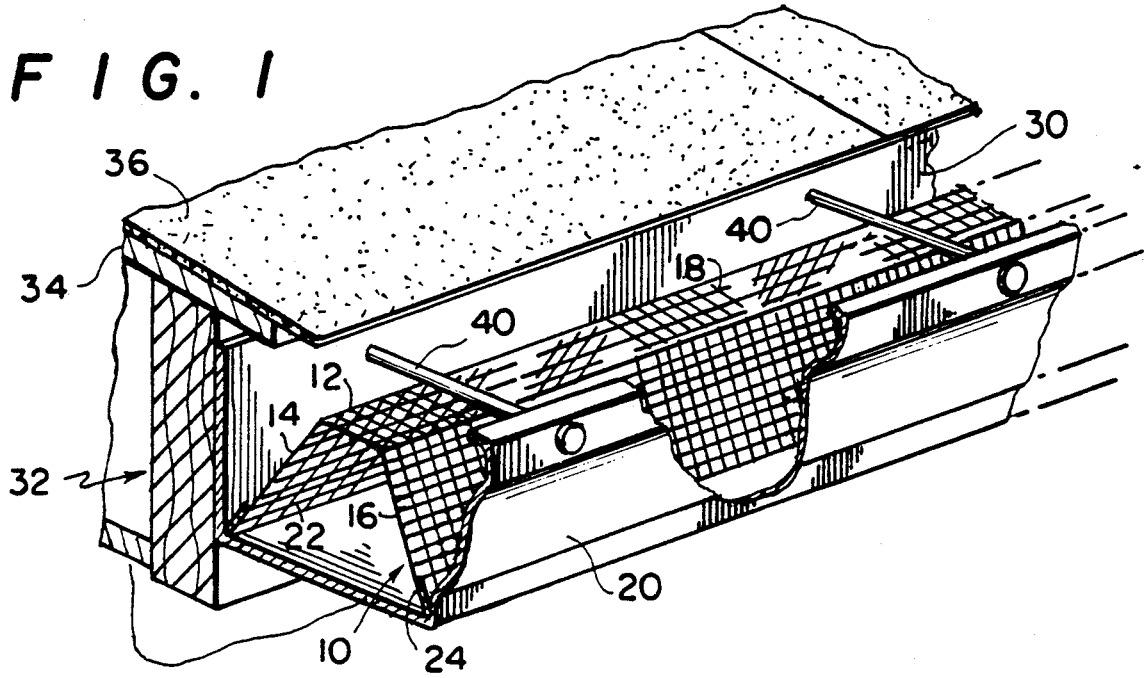
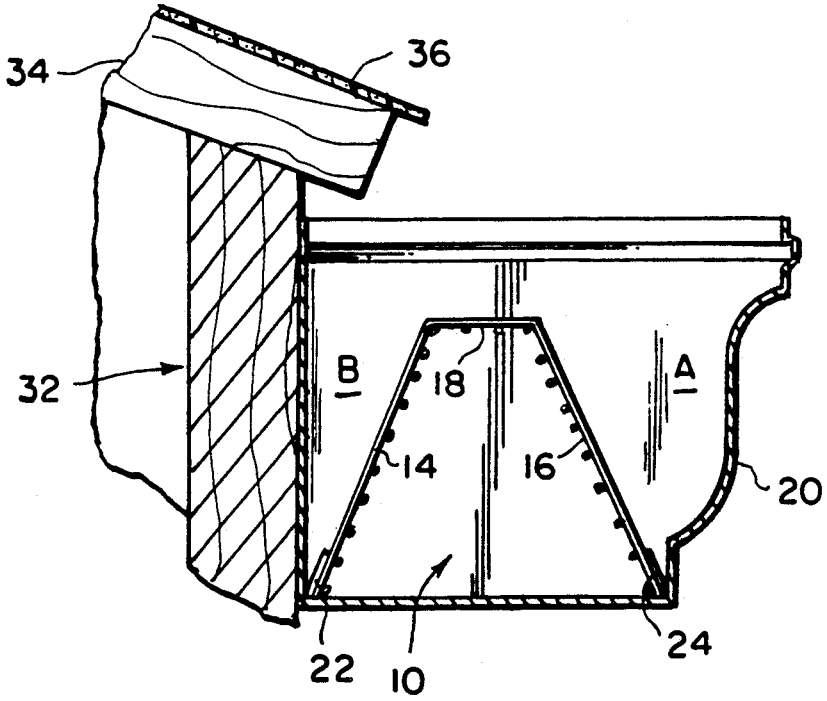
FIG. 2

TRILATERAL GUTTER GUARD

BACKGROUND OF THE INVENTION

Gutter guards are known for preventing leaves and other debris from entering a longitudinally extending roof gutter and blocking the flow of water therethrough. U.S. Pat. No. 4,841,686 to Rees depicts one such guard wherein horizontal elongated meshed screen is disposed longitudinally across the top of the gutter. A problem with this design is that leaves, branches, etc. tend to catch on the top of the gutter guard and become packed together, thus preventing water from reaching the gutter. In extreme situations, the entire gutter guard is blocked by debris, effectively preventing any water from reaching the gutter.

Swenson (U.S. Pat. No. 2,457,940) depicts a longitudinal gutter guard in a V-shape which is inserted into the gutter itself. However, leaves and other debris again tend to become packed within the V-shaped guard, preventing water from flowing through to the gutter.

Hughes (U.S. Pat. No. 2,317,272) discloses a longitudinal gutter guard formed with a transverse cross-section that is tent-like, and extends above the top of the gutter. With this design, however, the debris flowing from the roof tend to pack against the gutter guard surface adjacent the roof, which will prevent run-off water from reaching the gutter.

Hopkins (U.S. Pat. No. 4,607,465) discloses a longitudinal gutter guard having a transverse cross-section that is curvilinear, but effectively producing the same results as the Hughes device. That is, leaves and other debris washed off of the roof tend to pack against the gutter guard, effectively obstructing the flow of water.

Ebeling et al. (U.S. Pat. No. 4,112,691) discloses a rain water roof outlet comprising a vertical down pipe and a trough fixed to the upper end of the pipe. A lid is fastened to the trough above the inlet the pipe and is larger than the inlet and the pipe and causes water to flow radially in the trough to the inlet end and prevents suction of air into the pipe when the water level in the trough is above the lid. However, since the lid is only located adjacent the top of the downpipe, leaves and other debris will still enter the gutter and eventually clog the holes in the lid.

While the broad concept of a gutter guard is known, the specific guards known are considered incapable of providing a structure whereby both longitudinal flow of water in the gutter is unhindered, and transverse flow of water into the gutter also is not blocked. No known gutter guard is capable of performing a self-cleaning function wherein the leaves and other debris are regularly cleaned from the gutter by natural forces.

Thus, what is needed is a simple, reliable gutter guard capable of overcoming the problems of known guards described above.

SUMMARY OF THE INVENTION

The present invention overcomes the problems of prior art gutter guards noted above, and provides a simple, easy-to-manufacture, easy-to-assemble, maintenance-free gutter guard.

In accordance with one aspect of the present invention, a longitudinal gutter guard includes a first angled leg adapted to rest on the longitudinally extending bottom of the gutter. A second angled leg is also adapted to rest on the bottom of the gutter at a location different from the first angled leg. A substantially horizontal leg connects the tops of the first and second legs, and each of the three legs comprises a mesh. Preferably, the gutter presents a trapezoidal transverse cross-section with the horizontal leg being substantially one and one quarter inches wide.

According to another aspect of the present invention, a longitudinally extending apparatus for preventing debris from clogging a longitudinally extending gutter includes a first resilient mesh leg adapted to sit on a bottom of the gutter and extend upward. A second resilient leg is adapted to sit on the bottom of the gutter at a position spaced apart from the first leg, and to also extend upward. A third mesh leg is coupled between top portions of the first and second legs, wherein the first and third legs are capable of passing water therethrough while restricting passage of the debris.

According to a further aspect of the present invention, a longitudinal gutter guard comprises a one-piece mesh material having two edges adapted to be supported by an inside surface of the gutter. A substantially horizontal surface is located between the two edges and is adapted to be disposed inside of the gutter and spaced about one half inch below the gutter top edge. Preferably, the gutter guard presents a generally trapezoidal transverse cross-section and also has longitudinal runners of aluminum that are disposed along each edge so as to rest on the bottom surface of the gutter.

BRIEF DESCRIPTION OF THE DRAWINGS

The above-noted features of the present invention will be more clearly understood when taken together with the following detailed description of the preferred embodiment and the attached figures in which:

FIG. 1 is a perspective view showing the gutter guard according to an embodiment of the present invention in an intended use, installed in a longitudinal gutter;

FIG. 2 is a transverse cross-section of the FIG. 1 embodiment; and

DETAILED DESCRIPTION OF THE PREFERRED EMBODIMENT

Figure 3:
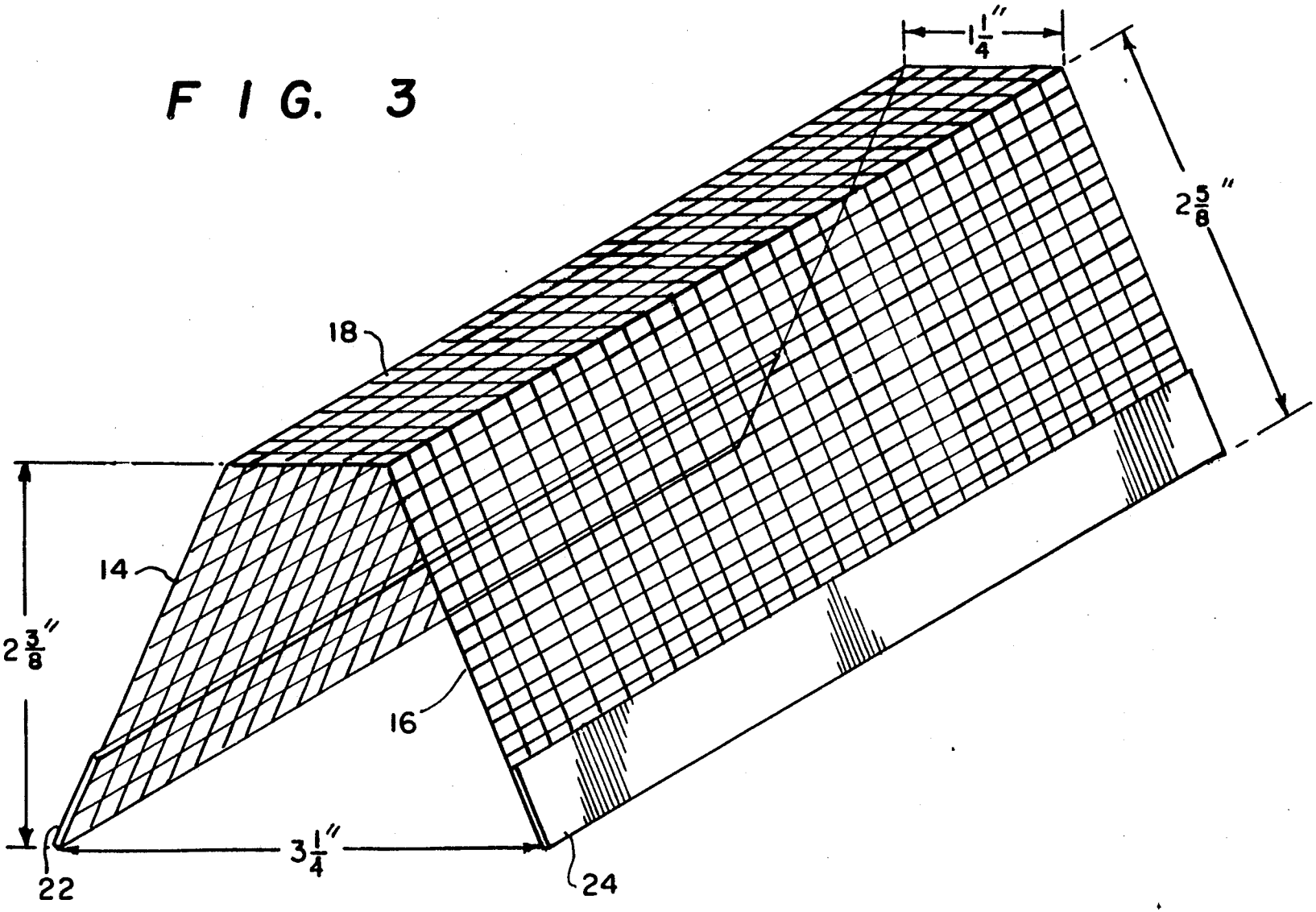
FIG. 3 is a perspective view of the gutter guard outside of the gutter.

A gutter guard according to the present invention has a unique design which allows the gutter to be cleaned by natural forces. The preferred embodiment is a unitary longitudinally extending mesh structure with a trilateral (3-legged) design that presents a generally trapezoidal transverse cross-section. Such a mesh structure presents a greater area for filtering water therethrough, and prevents leaves and debris from packing in the gutter or on the gutter guard. Further, a horizontal upper surface of the gutter guard is preferably only one inch or one half inch below the top of a gutter rim, when installed according to an intended use. This feature allows leaves and debris resting on top of the gutter guard to be blown away by wind or washed away by water flow. A more detailed explanation of the structure and advantages according to the present invention will now be provided.

FIG. 1 is a perspective view of gutter guard 10 resting within a standard, K-type gutter 20. The gutter 20 is affixed to a facia board 30 with pins 40. The facia board 30 is affixed to the building structure 32 immediately underneath roof 34, and overhanging shingles 36.

Gutter guard 10 generally comprises an unitary mesh structure 12 having a first, angled leg 14, a second angled leg 16, and a substantially horizontal leg 18. Narrow runners 22 and 24, of aluminum sheet stock preferably are attached longitudinally to the bottom edges of angled legs 14 and 16, respectively, so as to rest upon the bottom surface of gutter 20.

The gutter guard 10 essentially forms a longitudinal tunnel that is intended to sit within and inside the gutter 20, so as to not allow run-off water from the roof shingles 36 to transversely overshoot the top of the gutter 20, as with certain other designs. Since the trilateral gutter guard is an insert within the gutter, water will enter the gutter 20 before meeting any resistance from the gutter guard, in categorical distinction to previous designs. The three angled legs of gutter guard 10 present a significantly greater surface area for filtering water than known designs. Further, by angling the three leg surfaces as shown, water from roof 36 will hit each gutter guard leg surface at a different angle, thus aiding in washing away debris or breaking down debris collected against and leg. Once debris are broken down, they slip transversely through the mesh of gutter guard 10 and are carried away by the longitudinal water flow along the bottom surface of the gutter 20. Thus, increasing the area of the gutter guard increases the filtering action while preventing buildup of debris.

Since gutter guard 10 is intended to be within a K-type gutter 20, the mesh thereof is sheltered from the wind and other natural forces outside the gutter 20. Thus, gutter guard 10 is stable and protected, thus providing a long-lasting structure.

The gutter guard according to the present invention is self-cleaning, in more than one way; that is, debris are held above the gutter water level, where the debris can be naturally dried and blown out of the gutter by wind. Second, any debris that are broken down and filtered through the mesh of the gutter guard will be carried away by a water flow inside the gutter, that is both inside and outside of the lower edges of the first and second legs. Thus, a high flow of rain (or a cleaning hose if desired) can quickly and easily expel debris from the gutter or force them to be broken down and passed through the gutter and carried away by the water flow therein. Third, when layers of leaves are compacted against the outer surface of either the first or the second angled leg, run-off water will tend to pass between those leaves, and not impinge in a perpendicular fashion against the plane of each leaf.

The unique trapezoidal shape of the present gutter guard is structurally strong and will resist a great deal of force applied from above. Therefore, if a log or other heavy object falls into the gutter, the resilient gutter guard will not become deformed, as with other known designs. This is important in preventing a blockage of the gutter by packed debris. Further, the trapezoidal shape of the present invention allows the gutter guard to be installed either before or after of the gutter is affixed to the building. Thus, the gutter guard according to the present invention can be installed on existing gutters, or can be installed at the factory in order to deliver a gutter having an integral gutter guard therein.

Another advantage according to the present invention is that ice will not form inside the gutter since water will always tend to flow longitudinally therein because no large debris will tend to dam the flow. Freezing rain and snow tend to form a webbed crust of solid mass across the top and sides of the guard. As the crust builds up outside the gutter guard, the tunnel inside the guard is always open and the air temperature therein allows quick melting from the inside and immediate run off of the thus-melted water. When thawing occurs, the tunnel remains open allowing free passage of moving water and preventing ice from forming.

By disposing a narrow leg 18 that is substantially horizontal and approximately less than one inch from the top of the gutter 20, any leaves or debris falling on leg 18 will rest there until blown away by the wind. The space between leg 18 and the top of gutter 20 also prevents debris build-up since the debris will either blow out of the gutter or fall to the side of the gutter guard. The narrow, approximately one and one-quarter inch width also encourages leaves to be unstable, and fall downwardly against outer surfaces of the first and second legs.

FIG. 2 is cross-section drawing of FIG. 1 showing the various features of the preferred embodiment. As seen in FIG. 2, legs 14, 16, and 18 provide a trapezoidal transverse cross-section together with the bottom of gutter 20. This trapezoidal cross-section provides two outer, wedge-like areas, A and B, between outer surfaces of the gutter guard and the intervening sides of the gutter 20. Definition of such wedge-like longitudinally extending areas is important since debris will collect therein and be supported up and away from the water within gutter 20. The thus-supported debris will either dry and blow out of the gutter, or be broken down by agitation and filtered through the gutter guard into the tunnel-like structure where the debris will be carried away by the water flow. High volume water flow into these wedge-like areas A and B further assists in the agitation and breakdown of the debris contained therein.

Depending on the degree of overhang for roof shingles 36, water and debris may not enter into the wedge-like area B. In such a circumstance, some or all of leg 14 may not be an open mesh, although a unitary mesh structure is preferred so as to enhance air circulation within the gutter, that will aid in drying of leaves and debris resting against any outer surface of the gutter guard.

Runners 22 and 24 at the bottom of legs 14 and 16, respectively, enhance the structural stability of the gutter guard while providing a flat surface for contact with the bottom of gutter 20. The runners 22 and 24 are narrow and dimensioned so that small particles and debris will not enter the tunnel-like structure except, when lifted by water over the runner and through the mesh of the gutter guard. This feature assists in keeping the gutter clean and prevents obstruction of longitudinal water flow.

FIG. 3 is a perspective view of the gutter guard itself showing the preferred dimensions thereof. The 3¼ inch base width is intended to fit within a standard K-type gutter. Of course, this dimension may be varied depending upon the gutter structure. The height of leg 18 (2 and ⅜ inches) and the width of leg 18 (one and ¼ inches) specifically are adapted to fit within and inside a standard K-type gutter. Again, these dimensions may be varied if another type of gutter is used. However, any dimensioning is important so that the height and width of leg 18 will prevent debris build-up and aid in the self-cleaning of the gutter. That is, leg 18 should be positioned at a depth below the upper lip of gutter 20 that allows leaves and other debris to be blown away by the wind, while still sufficiently below the lip of gutter 20 to prevent debris from bridging the gap between the gutter lip and the leg 18. Further, the width of leg 18 should allow some leaves and debris to rest thereon to aid the natural cleaning, while preventing any significant horizontal leaf layer on the top of the gutter guard, that might experience water run-off in a direction perpendicular to the plane of each leaf. A number of experiments have indicated that the width of leg 18 should be substantially one or one and ¼ inches, to encourage tipping of leaves downward, and against either the first or second leg surface.

Preferably, a gutter guard according to the present invention comprises a single longitudinally extending sheet of ¼ inch opening aluminum mesh that is bent transverse into the desired trilateral shape. Narrow aluminum runners 22 and 24 may be one-half inch stock affixed by rivets at the bottom edge of each of the angled first and second legs 14 and 16. Of course, different mesh sizes may be specified in accordance with the type of debris to be found in the locality. Further, materials other than aluminum can be used, e.g., plastic, composites, etc. The selected material should be resilient so that the gutter guard will not be crushed by logs or other falling debris. Another preferable resilient material for the gutter guard is galvanized wire mesh. This has been used for initial testing and found to be excellent in terms of strength and resiliency. Further, the runners may be affixed to the galvanized wire mesh by crimping. The runners may be as much as ¾ of an inch high of stock aluminum.

While the present invention has been described in what is presently believed to be the most practical and preferred embodiment, other variations will become apparent to those of skill in the field, without departing from the spirit or scope of the appended claims. For example, the surface comprising the gutter guard need not each be strictly planar, but may be somewhat curvilinear in shape. Further, the three surfaces of the gutter guard may be bent from one mesh material, or may be of several types of materials coupled together. For example, the rear leg 14 may comprise a solid plastic, whereas the top and outer legs 18 and 16 may comprise a meshed structure. Also, the meshed structure may include slots, triangular holes, circles, or any other structure designed to pass water while restricting debris.

Thus, what has been described is a light-weight easy-to-install, easy-to-manufacture, simple, reliable gutter guard which is self-cleaning. There is no known gutter guard that sits completely inside the gutter on full length runner supports.

What is claimed is:

1. A longitudinal gutter guard comprising:

a first inclined leg adapted to rest on a bottom of a longitudinally-extending gutter;

a second inclined leg adapted to rest on the bottom of the gutter at a location different from the first inclined leg; and a substantially horizontal leg coupled to a top of said first and second legs, the three legs each comprising a mesh, each said leg extending in a longitudinal direction to allow fluid to flow longitudinally beneath said guard, said first and second inclined legs being spaced apart wider at a bottom thereof than at the top thereof.

2. A gutter guard according to claim 1 wherein said first, second, and horizontal legs together present a substantially trapezoidal transverse cross-section when the guard is installed in the gutter.

3. A gutter guard according to claim 1 wherein said legs comprise a unitary mesh structure, and wherein each of said first and second legs includes a runner along a bottom edge thereof.

4. A gutter guard according to claim 1 wherein said horizontal leg is substantially 1 inch plus or minus ½ inch wide, and wherein a distance between said horizontal leg and a gutter top is substantially 1 inch plus or minus ½ inch.

5. A gutter guard according to claim 1 wherein each of said legs comprises a mesh of resilient material comprising substantially ¼ inch square openings.

6. A gutter guard according to claim 5 wherein said resilient material comprises galvanized wire mesh.

7. Apparatus for preventing debris from clogging a longitudinally-extending gutter, comprising:

a first longitudinally-extending resilient leg adapted to sit on a bottom surface of the gutter and to extend upward;

a second longitudinally extending resilient leg adapted to sit on a bottom surface of the gutter at a position spaced apart from said first leg, and to extend upward; and a third substantially-horizontal longitudinally-extending resilient leg coupled between top portions of said first and second legs, said first and third legs capable of passing water therethrough while restricting passage of the debris to allow water to flow longitudinally through said gutter, said first and second legs being spaced apart wider at a bottom thereof than at the top thereof.

8. Apparatus according to claim 7 wherein said third leg is substantially horizontal and substantially one inch wide plus or minus ½ inch.

9. Apparatus according to claim 8 wherein said first and second legs each include a longitudinal runner along a bottom edge thereof.

10. Apparatus according to claim 9 wherein said legs comprise galvanized wire mesh, and wherein said runners comprise aluminum.

11. Apparatus according to claim 10 wherein said first, second, and third legs comprises an integral meshed material having a mesh size of substantially ¼ inch square.

12. Apparatus according to claim 7 wherein said third leg is substantially horizontal, and wherein a height of said first and second legs is predetermined to place said third leg within one inch of a top of the gutter.

13. A gutter guard comprising:

first and second mesh members adapted to rest on a bottom of the gutter at spaced apart locations, and to incline toward each other from the bottom of the gutters to a top thereof to provide a substantially trapezoidal cross-section; and a substantially horizontal mesh member coupled to said first and second members and disposed within said gutter one inch from a top thereof, said first, second, and third members extending longitudinally within the gutter to allow water to pass through said first, second and third members and to flow longitudinally in the gutter below said guard.

14. A gutter guard according to claim 13 wherein said third member is within ±20° of the horizontal.

15. A gutter guard according to claim 13 wherein the gutter has two bottom corners, and wherein said first and second mesh members are adapted to sit in the two bottom corners of the gutter, respectively.

16. A gutter guard according to claim 15 further comprising an aluminum runner coupled to a bottom edge of each of said first and second mesh members.

17. A gutter guard according to claim 13 wherein said first, second, and third mesh members each comprises aluminum or galvanized wire mesh having a mesh size of substantially ¼ inch square.

18. A gutter guard according to claim 13 wherein said third mesh member is disposed inside the gutter and comprises a substantially horizontal surface less than or equal to 1½ inches wide.

* * * * *